United States Patent [19]

Linton et al.

[11] 4,332,548

[45] Jun. 1, 1982

[54] CANDLE SAFETY DISC AND CANDLE

[75] Inventors: Robert Linton, Midland Park, N.J.; Frank Asbury, Warwick; Richard Artale, Middletown, both of N.Y.

[73] Assignee: Avon Products, Inc., Suffern, N.Y.

[21] Appl. No.: 77,901

[22] Filed: Sep. 24, 1979

[51] Int. Cl.[3] ..... F23D 3/16; C10L 5/00

[52] U.S. Cl. ..... 431/289; 431/288; 431/291; 44/7.5

[58] Field of Search ..... 431/291, 288, 289; 44/7.5

[56] References Cited

U.S. PATENT DOCUMENTS

| | | | |
|---|---|---|---|
| 3,797,990 | 3/1974 | Rogers et al. | 431/291 |
| 3,819,342 | 6/1974 | Gunderman et al. | 431/288 |
| 3,843,312 | 10/1974 | Easterday | 44/7.5 |
| 3,898,039 | 8/1975 | Lin | 44/7.5 |

*Primary Examiner*—Samuel Scott
*Assistant Examiner*—Wesley S. Ratliff, Jr.
*Attorney, Agent, or Firm*—Sigalos & Levine

[57] ABSTRACT

A transparent safety layer for a transparent candle comprising a thermoplastic polyamide resin and a solvent for said polyamide resin which is also compatible with said transparent candle; said polyamide resin and said solvent being present in amounts to give said transparent safety layer a higher viscosity and melt temperature than said transparent candle composition.

4 Claims, 3 Drawing Figures

CANDLE SAFETY DISC AND CANDLE

BACKGROUND OF THE INVENTION

It is well known that candles of the type comprising a candle wax or polymer in a metal or glass container frequently contain bits of extraneous material, such as charred portions of wick and matches which can be ignited by the burning wick resulting in a sudden explosion of flame called "flaring." As is evident, such flaring may harm the person who is lighting the wick, or cause the candle container to break if it is glass which also may injure the person lighting the wick. A successful effort to control this problem, is disclosed in U.S. Pat. No. 3,797,990, and assigned to the assignee of the present invention, which is directed to a candle in which a safety wax is placed in the bottom of a candle container, the wick and wick clip are placed either on top of or underneath the safety wax, and the candle wax is then charged into the container. As the candle burns towards its end, the safety wax melts and mixes with the candle wax to entrap foreign particles and inhibit the flow of candle wax to the flame, thus extinguishing the candle and preventing flareup.

While it was found that the invention disclosed in U.S. Pat. No. 3,797,990 performed its function well with opaque candles, it was found to be not entirely suitable for a transparent candle.

SUMMARY OF THE INVENTION

The present invention permits preparation of transparent candle compositions which prevent flaring and the resulting damage to persons and property while remaining transparent during their useful life.

Briefly, the present invention comprises a transparent layer for a wick-containing transparent candle composition in a container comprising a thermoplastic polyamide resin, a solvent for said polyamide resin which is also compatible with said transparent candle composition; said polyamide resin and solvent being present in amounts to give said transparent safety layer a higher viscosity and melt temper ture than said transparent candle composition.

DETAILED DESCRIPTION OF THE DRAWINGS

Figure 2:
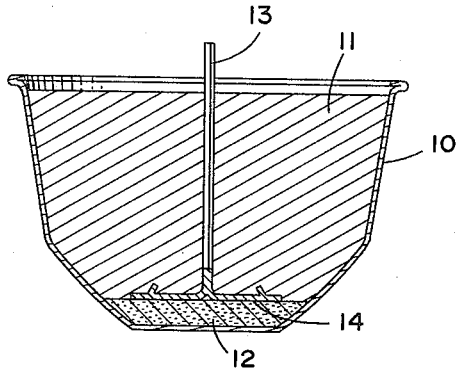
FIG. 2 is a cross-sectional view of a candle of the present invention.

The invention will be described in connection with the drawings which show candle container 10 having upper transparent candle composition layer 11 and lower transparent safety layer 12 with wick 13 extending beyond the upper surface of layer 12.

The container 10 may be made of any heat resistant material with plastics and glass being most commonly used. Wick 13 is of any conventional wick material and preferably is held by a conventional wick clip 14. The wick assembly may be positioned atop safety layer 12 as shown in FIG. 2 or layer 12 may be placed thereover as shown in FIG. 3.

Upper transparent candle composition layer 11 can be any conventional transparent candle composition, but preferably is the composition disclosed in U.S. Pat. No. 3,819,342; the disclosure of that patent being specifically incorporated herein. Basically, such composition comprises a thermoplastic polyamide resin and a flammable solvent therefor capable of solubilizing the resin at a temperature below about 230° F. and of forming a gel-type structure with said resin.

In such compositions it is possible to use the polyamide resin in amounts from about 5 to 35 parts by weight for each 100 parts by weight of the composition; with an upper limit of 10 parts by weight being most suitable.

Figure 3:
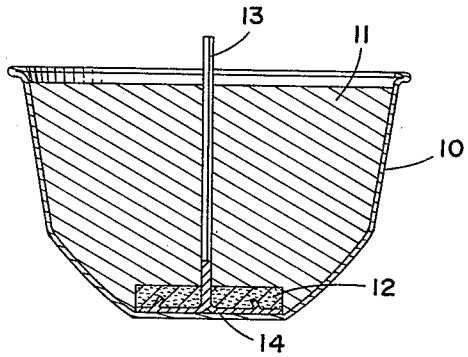
FIG. 3 is a cross-sectional view of an alternate embodiment of a candle of the present invention.
Figure 1:
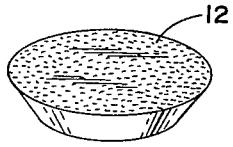
FIG. 1 is a perspective view of a transparent safety layer of the present invention in the form of a disc.

The transparent safety layer 12 is substantially noncombustible in the conditions that prevail in a candle and can be of any shape and preferably conforms to the shape of the bottom of container 10 as shown in FIGS. 2 and 3. The wide variety of such possible shapes are hereinafter collectively referred to as a "disc". The two essential components of the disc are the thermoplastic resin and the solvent.

As to the thermoplastic polyamide resin it can be the same resin as used in the upper candle layer as described in U.S. Pat. No. 3,819,342; such resins being commonly available under the trade name VERSAMID.

With respect to the solvent it must be a solvent for the polyamide resin and also compatible with the upper transparent candle composition. Suitable solvents are unsaturated fatty acids (preferably $C_{10}$–$C_{30}$), unsaturated fatty alcohols (preferably $C_{10}$–$C_{30}$), saturated fatty alcohols (preferably $C_6$–$C_{30}$), esters of fatty acids (preferably $C_6$–$C_{30}$) with polyhydric alcohols and glycerol, or mixtures thereof. Of these, the saturated fatty alcohols are preferred.

The proportions of resin and solvent in the disc are critical. The disc 12 must have a higher melt temperature and viscosity than the upper candle layer 11 and yet must be compatible with said layer. This is best accomplished by having a higher concentration of polyamide resin in the disc than in the upper candle layer. For each 100 parts by weight of the safety disc, 10 to 80 parts by weight of polyamide resin are used. It is preferred to use essentially equal parts by weight of resin and solvent; only enough solvent need be present to dissolve the resin and aid in forming the gel. The disc is formed by simply admixing the polyamide resin and solvent in the desired proportions and a thickened gel is formed which can be molded to any shape desired. Molding is effected by putting the mixture into the desired container prior to gelling. Alternatively, discs can be molded separately in properly shaped molds and placed in the final container as a solid disc. If it is desired to have the disc above the wick assembly as shown in FIG. 3, it is only necessary the candle wick be inserted into the mixture prior to gelling.

The upper candle layer, prepared as described in U.S. Pat. No. 3,819,342, can then be added to the container to complete the candle.

If desired, a small amount (usually less than about 5 parts by weight) of a dispersible material capable of retarding the capillary action of the wick can be added to the safety disc. Such dispersible material, as hereinafter described, also has the same effect on foreign materials, such as charred matches, which can act as a wick. Such dispersible materials include fumed silica, precipitated silicon dioxide, silica flour, silicon dioxide, and mixtures thereof.

In addition, additives conventionally added to candles such as coloring agents, perfumes, clarifying agents, antiflaming agents and the like can be added to the disc layer in their usual amounts for their usual effects. It is pointed out, however, that only such additives can be used as do not adversely affect the transparency of the disc.

The safety disc functions in the following manner. As the candle burns towards the bottom of the container, the safety disc melts and mixes with the candle material to entrap all foreign particles (usually charred matches and other materials used to light the candle) and to inhibit the flow of the candle fuel to the flame thus extinguishing the candle and preventing flareup.

The entrapping qualities of the safety disc are believed to be a result of the higher viscosity of the melted mixture of the disc and candle layer as the same melt and combine. The foreign materials sink therein and are entrapped in the substantially non-combustible mixture. Extinguishing is a result of impeding the flow of candle fuel to the wick because of its combination with the material of the safety disc. Safety discs containing the dispersible materials discussed above are most effective in extinguishing the flame since they retard the capillary action of the wick and foreign materials. Loss of capillary action results in snuffing out the flame and thus prevents flareup as the candle burns to the bottom.

With this invention one is able to obtain a completely transparent candle which will not flare so as to cause damage or injury.

The invention will be further described in connection with the following example which is set forth for purposes of illustration only and in which proportions are in parts by weight unless expressly stated otherwise.

EXAMPLE

A transparent safety disc is formed by admixing the following components and either permitting them to gel in the bottom of a transparent container or casting discs in a mold of appropriate size and configuration:

| | Pts. by Wgt. |
|---|---|
| Polyamide resin (BC-1283) | 49.498 |
| Isohexacosanol | 49.498 |
| Silicon dioxide (fumed) | 1.000 |
| Solvent Blue 35 | 0.004 |

A wick assembly is placed over the gelled disc and then the following transparent candle fuel layer is added to the container:

| | Pts. by Wgt. |
|---|---|
| Polyamide resin (BC-1283) | 20.0000 |
| Isohexacosanol | 36.9491 |
| Mineral Oil | 36.9491 |
| Glyceryl Monooleate | 1.0000 |
| Ultraviolet light absorber (Uvinul D-50) | 0.1000 |
| Perfume | 5.0000 |
| Solvent Blue 35 | 0.0015 |
| Color (D & C Violet No. 2) | 0.0003 |

The result is a slightly tinted transparent candle in which the safety disc is not visible as a separate structure.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A transparent candle comprising an upper transparent candle composition layer, a lower transparent safety layer, and a wick in at least said upper transparent candle composition layer, said upper transparent candle composition layer comprising a thermoplastic polyamide resin and a flammable solvent therefor, said transparent safety layer being substantially noncombustible and comprising a thermoplastic polyamide resin, a solvent for said polyamide resin which is also compatible with said transparent candle composition, said polyamide resin and solvent being present in amounts to give said transparent safety layer a higher viscosity and melt temperature than said transparent candle composition layer.

2. The transparent candle of claim 1 including a dispersible material capable of retarding the capillary action of the wick.

3. The transparent safety candle of claim 2 wherein said solvent for the safety layer is selected from unsaturated fatty acids, fatty alcohols, esters of fatty acids of polyhydric alcohols and glycerol, or mixtures thereof.

4. The transparent safety candle of claims 3 or 4 wherein said dispersible material is selected from fumed silica, precipitated silicon dioxide, silica flour, silicon dioxide, or mixtures thereof.

* * * * *